US006497628B1

(12) United States Patent
Gunderson

(10) Patent No.: US 6,497,628 B1
(45) Date of Patent: Dec. 24, 2002

(54) GOLF PUTTER

(76) Inventor: George A. Gunderson, 155 Juniper St., Mahtomedi, MN (US) 55115

( * ) Notice: Subject to any disclaimer, the term of this patent is extended or adjusted under 35 U.S.C. 154(b) by 0 days.

(21) Appl. No.: 09/573,951

(22) Filed: May 19, 2000

(51) Int. Cl.[7] ..... A63B 53/04; A63B 53/02
(52) U.S. Cl. ..... 473/313; 473/340; 473/341
(58) Field of Search ..... 473/251, 252, 473/253, 254, 313, 340, 341, 350, 249, 286, 324, 244; D21/741

(56) References Cited

U.S. PATENT DOCUMENTS 3,815,910 A * 6/1974 Raines
3,819,180 A * 6/1974 Murphy
4,314,701 A * 2/1982 Swanson
4,390,184 A * 6/1983 Rudell
4,722,528 A * 2/1988 Tsao
4,871,174 A * 10/1989 Kobayashi
4,872,683 A * 10/1989 Doran
4,915,385 A * 4/1990 Anderson
4,964,639 A * 10/1990 Tucker
5,267,733 A * 12/1993 Szokola
5,333,863 A * 8/1994 Shenoha
5,344,141 A * 9/1994 Smith
5,382,019 A * 1/1995 Sneed
5,542,665 A * 8/1996 Levocz
5,690,562 A * 11/1997 Sturm
5,709,613 A * 1/1998 Sheraw
5,749,791 A * 5/1998 Passeri
5,795,246 A * 8/1998 Hale
5,820,481 A * 10/1998 Raudman
5,913,731 A * 6/1999 Westerman
5,947,837 A * 9/1999 Perry
6,244,972 B1 * 6/2001 Drossos

* cited by examiner

*Primary Examiner*—Sebastiano Passaniti
(74) *Attorney, Agent, or Firm*—Jackson and Johnson

(57) ABSTRACT

A putter having a hollow tubular member extending rearward from the putter blade with the shaft connected to said hollow tubular member.

4 Claims, 3 Drawing Sheets

3
4
5
11
12
13
14
14A
14B
14C
15
16
20
21
23
25
30

30
13
11
17
12
25
15
16
22
23
20

GOLF PUTTER

BACKGROUND OF THE INVENTION—Field of the Invention

This invention is directed toward golf putters and more particularly, to the construction and function of the blade or head and the manner in which the shaft is attached or connected to the blade.

DESCRIPTION OF THE PRIOR ART

Because of the importance of putting to scoring well in the game of golf, serious golfers spend a great deal of time practicing putting and looking for and using a variety of putters which may help improve their putting stroke and thereby improve their score. As a result there have been a large number of putters designed, some of which are patented—some of which are not, but which have been advertised and promoted as being an improved tool in the putting game. Typically is U.S. Pat. No. 5,267,733 by Szokola. Szokola somewhat generally describes many of the frustrations and concerns relating to putters along with the terminology that is used and recognized by serious golfers regarding the problems they encounter with their putters. Parenthetically a serious golfer can range from a once-or-twice a week summertime only golfer to the full-time touring professional. Without getting into detail, the Szokola patent deals with the hosel for mounting or attaching or connecting the shaft to the putter blade in combination with the shaft location with respect to the blade for use by the golfer in aligning the putter blade to the ball for striking the ball and moving it in the right line.

Another prior art putter is U.S. Pat. No. 3,815,910 by Raines which is a little unusual. It is directed toward making the putter blade out of a tubular material or casing and then filling the casing and closing off the ends and combining that with a double goose-neck type of connection to the shaft.

Yet another prior art putter patent is U.S. Pat. No. 4,722,528 by Tsao. This patent talks about the "sweet spot" and "feel" of the putter to the golfer somewhat along the same lines as the Szokola patent referred to previously. Tsao deals in part with the weight or feel of the putter somewhat based on the nature of the blade material that is made in part with a low density material and in part with a relatively heavier or high density material which relates particularly to the feel of the club. In addition, Tsao combines a sighting device for use by the golfer to align the club face with the ball to impact the ball at the right spot to move it in the proper line. This apparently is achieved by attaching the shaft in such a fashion that when aligning the putt the golfer's head and eye are slightly behind the ball.

Other U.S. putter patents are U.S. Pat. Nos. 5,795,246 and 5,382,019 which deal with the shape of the putter blade and the attachment of the shaft to the blade, sometimes referred to as the hosel attachment. Still others are U.S. Pat. Nos. 5,709,613 and 5,542,665 which deal with adjustability of putters for shaft attachment angles and/or adding or removing weight.

Applicant is aware of other putter patents but they are not at all related to the instant invention except that they are aimed at the ultimate result of providing the golfer with a putter that can be relied upon to help in scoring. In addition, of course, there are a large number of various putters of various designs which are commercially available, many of which are not patented.

SUMMARY OF THE INVENTION

The present invention is aimed at widening the "sweet spot" on the ball-striking face of the putter blade or head by minimizing twist of the blade when the ball is impacted, even if off-center of the putter blade. In the preferred form a hollow member is attached to and extends rearward from the back surface of the putter blade. The hollow bore of this member is located behind the preferred ball-striking area on the face of the blade. The shaft is attached or connected to the hollow member. The hollow member may be rectangular or circular in form or may take the form of other geometric shapes. It is preferred that the width of the hollow member be about equal to the diameter of a golf ball and perhaps even slightly larger.

The back side of the putter blade may contain a recess at the ball-striking area which conforms generally to the hollow area. It has been found that eliminating some mass behind the ball-striking face of the putter in the ball-striking area may also help to reduce twist or turning of the blade should the golfer strike the ball somewhat off center. In other words, the sweet spot, the perfect spot at which the ball should be impacted with the putter blade, may be effectively somewhat enlarged thereby allowing the golfer a greater margin of error in the striking or impacting the ball with the putter blade to keep the ball in line while rolling to the hole.

As an added feature, the width of the cavity and/or extension member can be used by the golfer to frame the ball when lining up the putt to help accurately position the ball with respect to the "sweet spot" or preferred ball-striking area on the putter blade.

DESCRIPTION OF THE PREFERRED EMBODIMENTS

Figure 1:
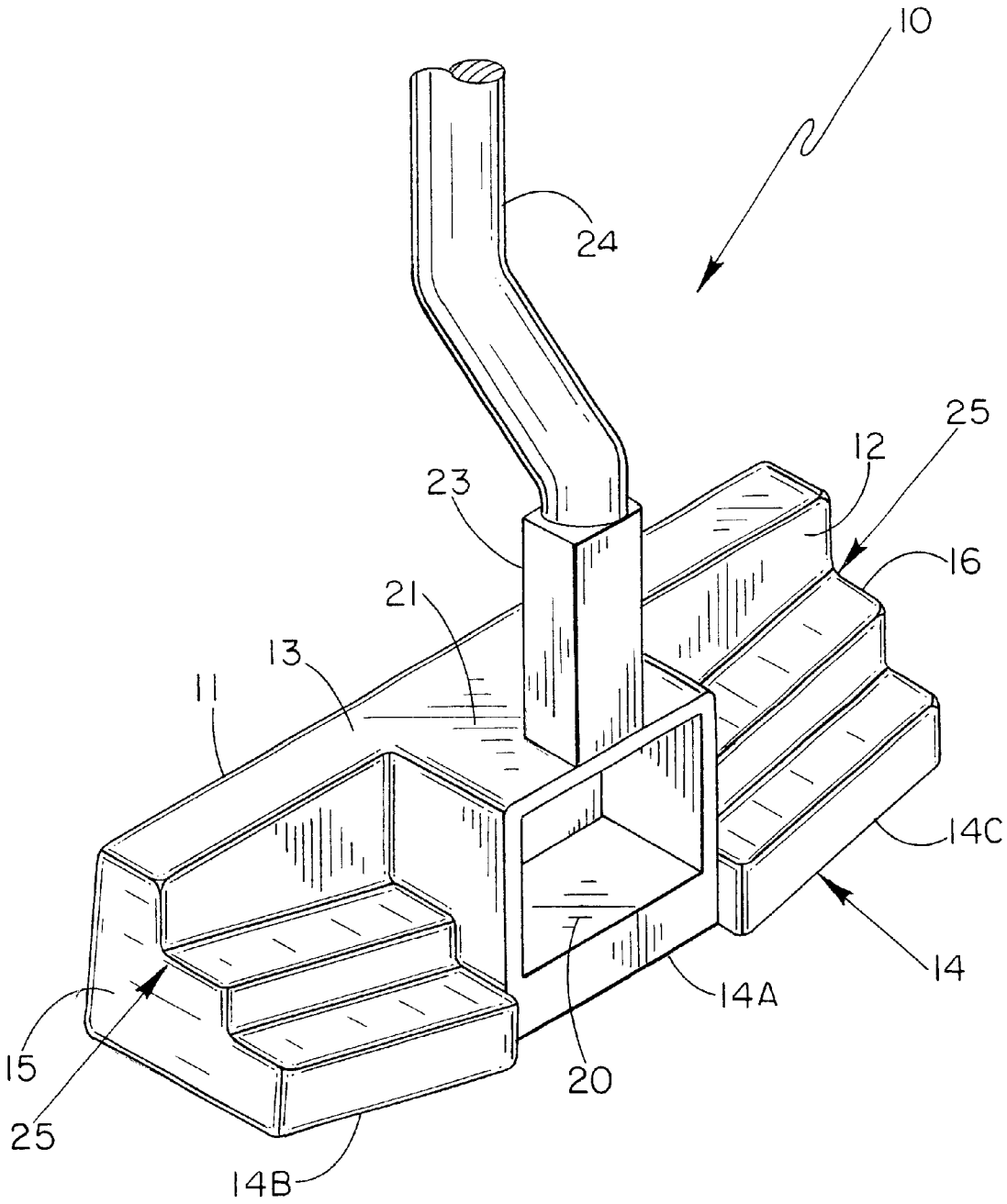
FIG. 1 is a perspective view of an embodiment of the invention.
Figures 2, 3, 4, 5:
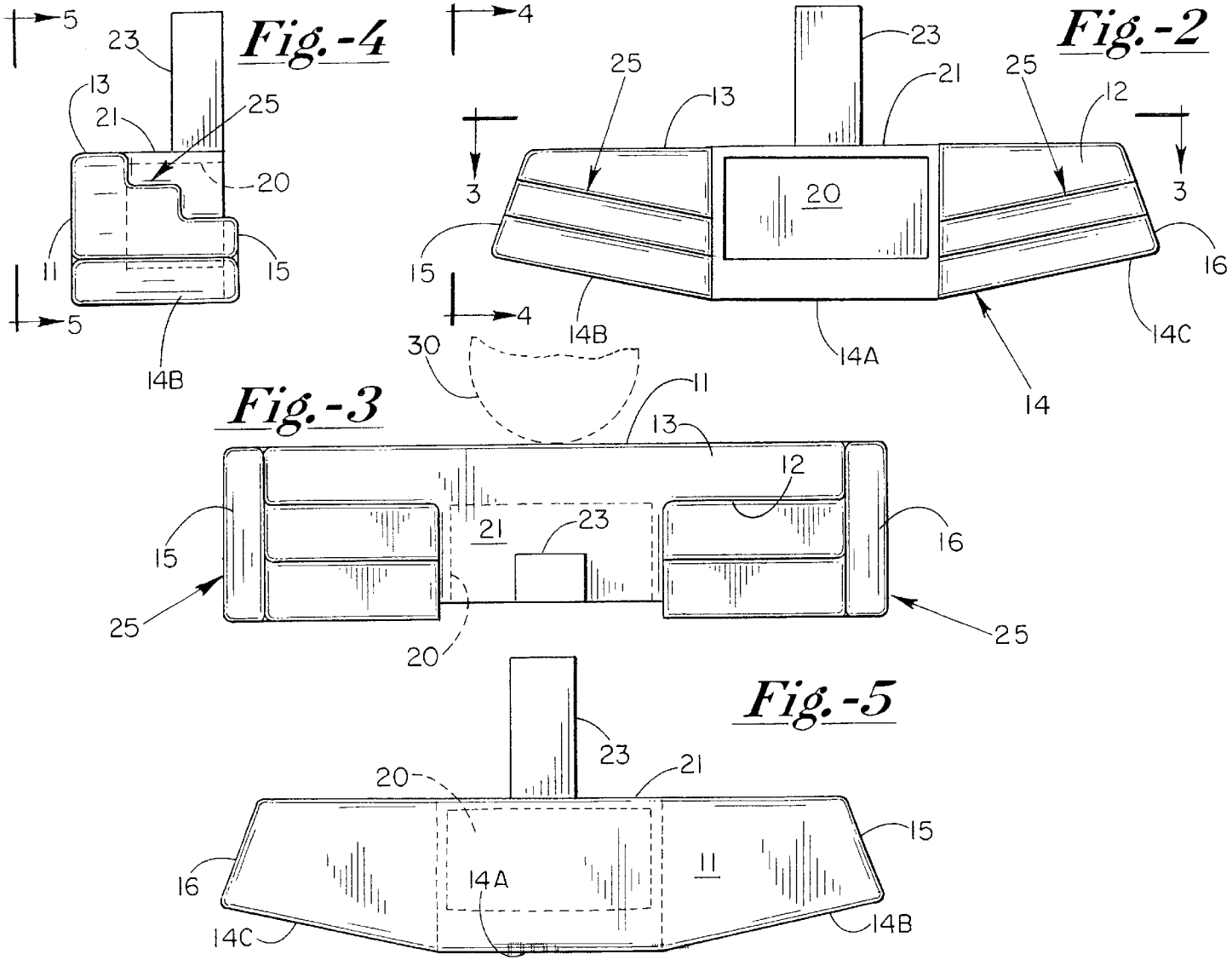
FIG. 2 is a back or rear view of the embodiment illustrated in FIG. 1.
FIG. 3 is a plan or top view.
FIG. 4 is an end view.
FIG. 5 is a face or front view.

The head or blade 10 of a putter has a front ball-striking face or surface 11, a rear surface generally designated by reference numeral 12, a top edge 13, a bottom edge or sole 14 and heel and toe side edges, respectively 15 and 16. (The heel and toe designations assume it's a right-handed putter.) The head or blade is preferably made out of materials that are commonly and conventionally used such as brass, bronze, carbon steel, stainless steel, or aluminum, or combinations thereof. In the illustrated embodiment the sole or bottom edge 14 of blade 10 is shown as having a central generally horizontal area 14A which is generally parallel to the top edge 13 and right and left upwardly angled areas 14B and 14C extending from section 14A to respective side edges 15 and 16. This is merely a matter of choice and does not play a part in the instant invention as claimed although may be of value or importance to the golfer. Similarly, the face or ball-striking surface 11 may be slightly angled but this also is a matter of choice.

A recess 17 (FIG. 6) or depression may be formed in the rear of the putter blade or head 10 behind the ball-striking surface of face 11 at the preferred ball-striking area. Some of the mass of the material from which the head or blade is made is thereby removed from the area immediately behind the preferred ball-striking area or sweet spot of the putter face 11 so that blade 10 is somewhat thinner in the ball striking area than elsewhere. The depth of recess, i.e., the amount of material which is deleted, is a matter of choice. A number of different factors may affect the choice, such as the material from which the head is made, the overall size and weight of the head, etc. Naturally, there must be enough mass or thickness of material so that there is no give or flex to the face or ball-striking surface 11 when the blade strikes the ball. Recess 17 may be formed by either machining the putter blade or by being cast. Alternatively, blade 10 may not have a recess.

Extending rearward from the back 12 of club head 10 is a hollow tubular member 21. The hollow bore 20 of member 21 is centered or coaxial with the preferred ball-striking area of blade 10. If the blade has a recess 17, bore 20 is aligned with the recess. Member 21 can be cast as part of the head 10 or may be formed separately and then attached, such as by welding, to the back of the blade.

Figure 6:
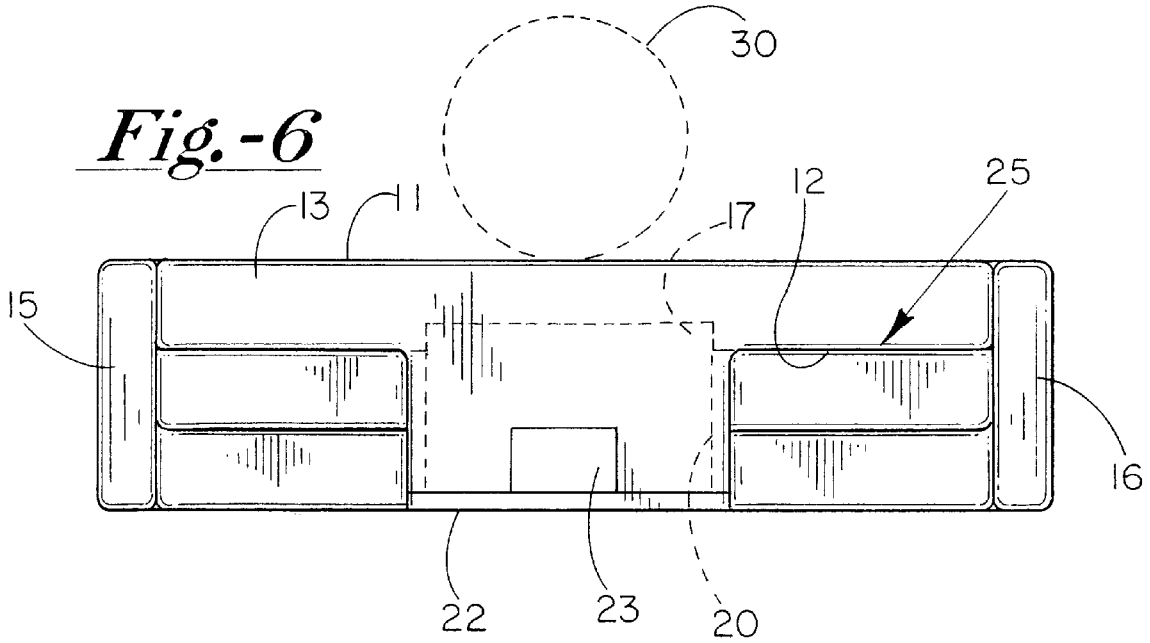
FIG. 6 is a top view of an alternate embodiment.

Preferably member 21 is a rectangular box-like structure but it also could take other geometrical shapes such as circular, triangular, oval, etc. The rear end of member 21 may be left open or closed off with a plate member 22 (FIG. 6). An upward extension or hosel 23 from the top of member 21 has an opening at its upper end for receiving and engaging an end of shaft 24 shown in FIG. 1. The extension 23 may be angled in part. The hollow bore 20 of member 21 can be open at its back rear end or closed off with plate member 22 or something similar as illustrated in FIG. 6. As a further alternative, bore 20 could be filled with some suitable material if desired. The material should be such that it would not add any significant mass to the blade behind the ball-striking area.

It has been found that the width of the hollow bore 20, i.e., the dimension from side to side, should preferably be about equal to the diameter of golf ball 30 shown in dashed line. In general it is preferred that the ball-striking area be centered on the club face 11 midway between the heel and toe edges and correspondingly, member 21 should be similarly centered. However, the preferred ball-striking area may be elsewhere along the face 11 of the club head and correspondingly, member 21 should be similarly located. In any event, the hollow bore 20 should be centered with respect to the preferred ball-striking area on the face of the blade.

The undulations on the rear surface of club head 10 which are designated generally by reference numeral 25 are formed by weights on the club head or blade to provide the feel of the putter. Since some amount of mass may be removed or not be present on the putter blade, weight may be added alongside member 21, preferably evenly distributed, in order to give the golfer the feel that he or she ordinarily likes in a putter. The amount of weight is a matter of choice and can be varied to accommodate the likes and dislikes of each individual golfer. The undulating form is shown only as a matter of styling and appearance. Again, this is intended to adapt to the golfer so that the putter has the look that he or she likes. Again, weight can be added or removed as necessary and be made in different shapes and forms as desired to accommodate the likes and dislikes of a golfer.

A further feature of the invention is that the hollow member 21 can be used by the golfer to "frame" the ball when lining up the putt. In other words, because the width of member 21 is just slightly greater than the diameter of the golf ball, the golfer can use member 21 as a guide for placing the ball as near as possible to the center of the ball-striking area on the face of the putter. This is an added feature which provides the golfer with a good feel for the putter which is, as mentioned earlier, important to the golfer.

The top edges of member 21 not only frame the ball, but since they are perpendicular to the ball-striking face they can be used to provide assistance in aiming, i.e., aligning the club face to roll the ball in the desired direction. It should be noted that in a mallet style head, these edges would not be visible as such so would not provide this additional feature.

I claim:

1. A putter, comprising:

a putter blade having a ball-striking face, a back surface, a top edge, a continuous uninterrupted sole, and heel and toe side edges;

a recess in the back surface of said blade between said top edge and said sole, said recess eliminating mass behind the ball-striking face to define a ball striking area, said recess having a width substantially equal to the diameter of a golf ball;

a shaft connected to said blade; and a hollow tubular member attached to the rear surface of said blade, the bore of said tubular member substantially coextensive with said recess and centered with respect to said recess to prevent said blade from twisting upon impacting a golf ball at a point on said blade within the area of said recess.

2. A putter as described in claim 1 wherein said shaft is connected to the top of said tubular member.

3. A putter as described in claim 1 further including a closure at the back end of said hollow tubular member.

4. A putter as described in claim 2 wherein said shaft is connected to the back end of said hollow tubular member.

* * * * *